US006023871A

United States Patent [19]

Horowitz

[11] Patent Number: 6,023,871

[45] Date of Patent: Feb. 15, 2000

[54] ADVERTISING ATTACHMENT FOR IN-STORE SCANNING PLATE

[75] Inventor: Moshe Horowitz, Pleasantville, N.Y.

[73] Assignee: Elite Marketing Ltd., Long Island City, N.Y.

[21] Appl. No.: 08/871,617

[22] Filed: Jun. 9, 1997

[51] Int. Cl.[7] ..... G09F 3/00

[52] U.S. Cl. ..... 40/642.01; 40/649

[58] Field of Search ..... 40/642.01, 649, 40/651, 653, 654, 654.01; 248/314, 225.11, 224.51; 211/59.1, 57.1

[56] References Cited

U.S. PATENT DOCUMENTS

| | | | |
|---|---|---|---|
| 1,159,735 | 11/1915 | Beers | 40/745 |
| 2,641,427 | 6/1953 | Krogh | 40/757 |
| 3,918,187 | 11/1975 | Vogele | 40/781 |
| 4,103,860 | 8/1978 | Haas et al. | 40/757 |
| 5,775,017 | 7/1998 | Morrow | 40/642.01 |

*Primary Examiner*—Cassandra H. Davis
*Attorney, Agent, or Firm*—Cohen, Pontani, Lieberman & Pavane

[57] ABSTRACT

An advertising attachment to be used with a scanning plate of a hanger bracket where the advertising attachment has at least a base plate on which advertisements or product information can be printed. The advertising attachment has an opening through which information displayed on the face of the scanning plate can be read or scanned. An additional plate may be used to provide a more suitable surface for printing or to reduce costs. The advertising attachment has a structure for mounting, for instance, mounting hooks, parallel gripping ridges, or an insertion slot in the back of the base plate. Such an advertising attachment provides a highly simplified way of displaying advertisements within a compact display space.

9 Claims, 3 Drawing Sheets

ADVERTISING ATTACHMENT FOR IN-STORE SCANNING PLATE

BACKGROUND OF THE INVENTION

1. Field of the Invention

The present invention relates to an advertising display device, and more specifically, to an advertising display device adapted to attach onto the frame of a scanning plate.

2. Description of the Related Art

In merchandising, a well-known display device is an in-store hanger bracket having a rod-like supporting component. These hanger brackets usually have an additional attachment, a plate, which allows information about a product, such as price or a bar code, to be affixed onto the hanger. These plates are commonly referred to as scanning plates.

It is desirable to develop an advertising attachment to be used with these hanger brackets to increase brand awareness and visibility, highlight a special seasonal promotion and reinforce brand positioning. The problems associated with the designing of such an advertising attachment is that these hanger brackets are usually arranged to fit snugly in a limited display space; therefore, the advertising attachment must be small enough to fit in the compact display space without obstructing access to other products and the scanning plate while providing optimal amount of advertising space.

Additionally, the attachment must not break or fall easily through ordinary physical contact, because it is inevitable that consumers and store clerks will make physical contact with the advertising attachment through every day usage. The attachment must also be sturdy. A thin, flimsy label or flag that tends to bend or droop so that the information listed on its face cannot be seen would defeat its purpose.

These advertising attachments must also be inexpensive and releasably mountable onto the small frames of the hanger bracket because products are changed and moved around frequently, and the advertisements or information must be altered accordingly.

It is therefore an object of the present invention to provide an advertising attachment which is compact and, when used with a hanger bracket having a scanning plate, will not obstruct access to information listed on the scanning plate or other products while providing optimal advertising space thereon.

Another object of the present invention is to provide a highly simplistic and economical advertising attachment which is easily attachable and removable from a hanger bracket having a scanning plate.

It is a further object of the present invention to provide a sturdy advertising attachment that can withstand ordinary physical contact from every day usage.

SUMMARY OF THE INVENTION

The foregoing objectives have been met by the advertising attachment of the present invention which consists of a simple base plate formed from plastic or other sturdy materials and a structure for mounting the base plate onto a scanning plate of a hanger bracket. The base plate has an opening configured to fit around the scanning plate thereby allowing information listed on the scanning plate to be read or scanned. The face of the base plate provides a suitable surface for displaying advertisements relating to a displayed product. In a second embodiment, the advertising attachment would have an additional face plate which would provide a suitable surface for a less expensive means of applying advertisement to the plate, such as conventional printing. Or, to save cost, the base plate could be minimized while the face plate, made of a less expensive material, would be maximized to provide for an optimal advertising space.

The structure for mounting the attachment to the scanning plate preferably consists of four mounting hooks or a combination of mounting hooks and tabs. The length and the width of the hooks and spacing between them may be varied according to the size of the scanning plate. Once the advertising attachment is mounted onto the scanning plate, it cannot be easily displaced by ordinary physical contact from every day usage, although it can be easily removed when needed. Alternative mounting structure includes a pair of parallel, gripping ridges, or an insertion slot.

The simplicity of the present invention provides for a cost-effective means of displaying advertisement on a hanger bracket having a scanning plate as well as a compact design for minimizing intrusion of the display or storage space, thus allowing efficient use of the storage or display space.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF PREFERRED EMBODIMENT

Figure 1:
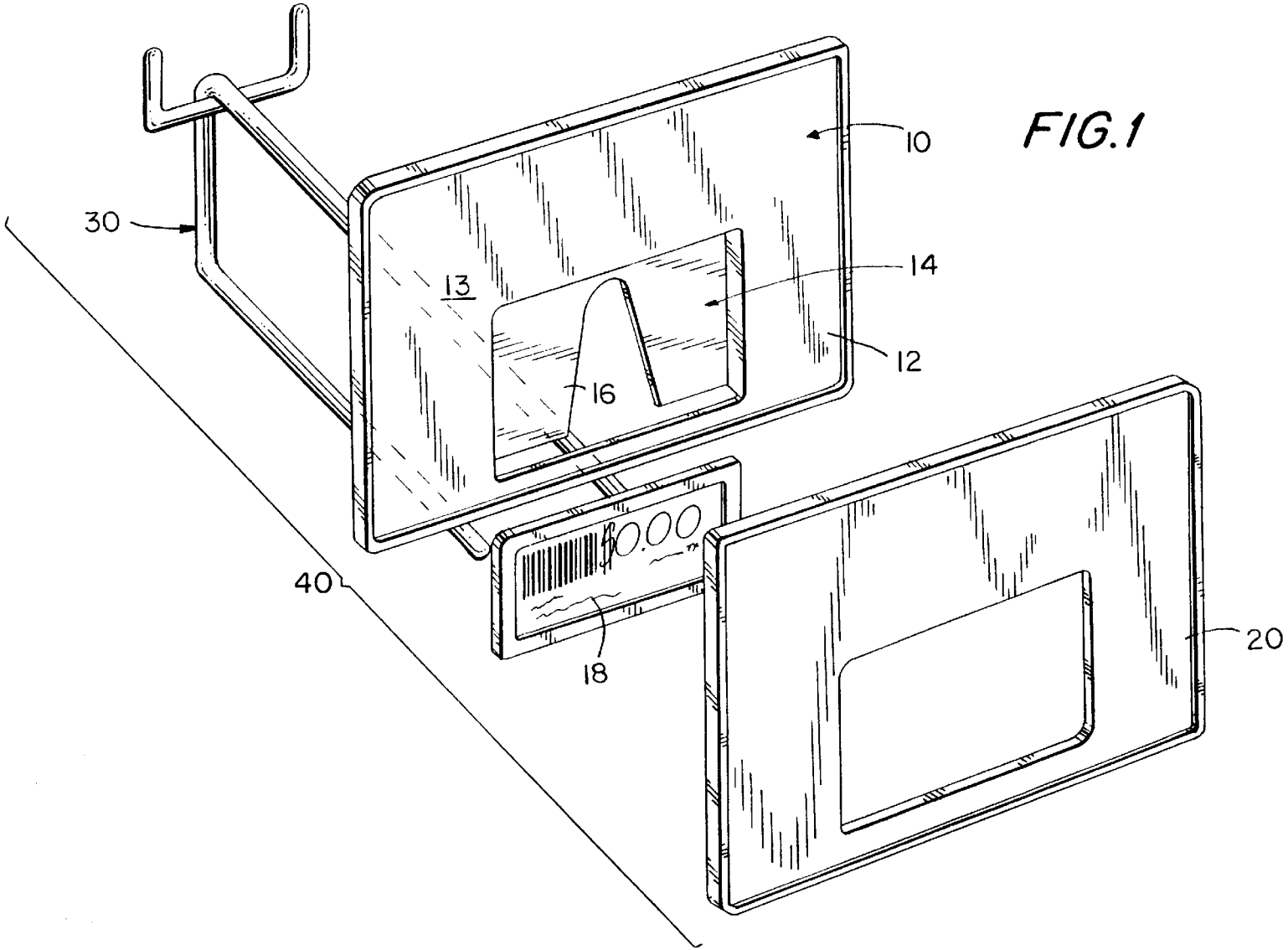
FIG. 1 is a perspective view of an advertising attachment according to the present invention having an insertion slot as the mounting structure, and an exploded view of a second face plate displaced from the advertising attachment.

Referring now to the drawings and initially to FIG. 1, an advertising display system 40 is shown. The advertising display system for a mounting support comprising a scanning plate 18 and an advertising display attachment 10. The mounting support may be, for instance, a hanger bracket 30. The advertising attachment has a base plate 12 preferably formed of a thin sturdy material, such as plastic which can be formed by injection molding, vacuum forming or other techniques known in the art. The base plate 12 has an opening 14 and a mounting structure, shown in FIG. 1 as an insertion slot 16. The opening 14 on the base plate 12 is sized and shaped to fit around or circumscribe a scanning plate 18 of a hanger bracket 30 without obstructing access to the information listed thereon. The insertion slot 16 can be formed by die-cutting back and bottom portions of the base plate 12, or by molding. Insertion slot 16 is sized and configured to mate with the scanning plate 18.

Once the advertising attachment 10 is mounted on the scanning plate 18, the opening 14 frames the scanning plate and allows the information listed thereon, such as a bar code or price information, to be read. The remaining surface area 13 surrounding the opening 14 provides a suitable surface for printing advertisements or other product information. Silk screening or the covering of the base plate 12 with another material, such as a self-adhesive mylar, can be used to apply the advertisement. The base plate 12 can also be adapted to hold removable acetates.

As shown in FIG. 1, the advertising attachment 10 may also comprise an additional member, a face plate 20. Face plate 20 may provide a suitable surface for a less expensive means of applying advertisement, such as conventional printing. To reduce costs, the size of the base plate 12 may be minimized while face plate 20, which would be made of a less expensive but firm material, such as cardboard, poster board, etc., may be maximized to provide an optimal amount of advertising surface. The face plate 20 may be affixed onto base plate 12 using adhesive or other means that is known in the arts.

Figure 2A:
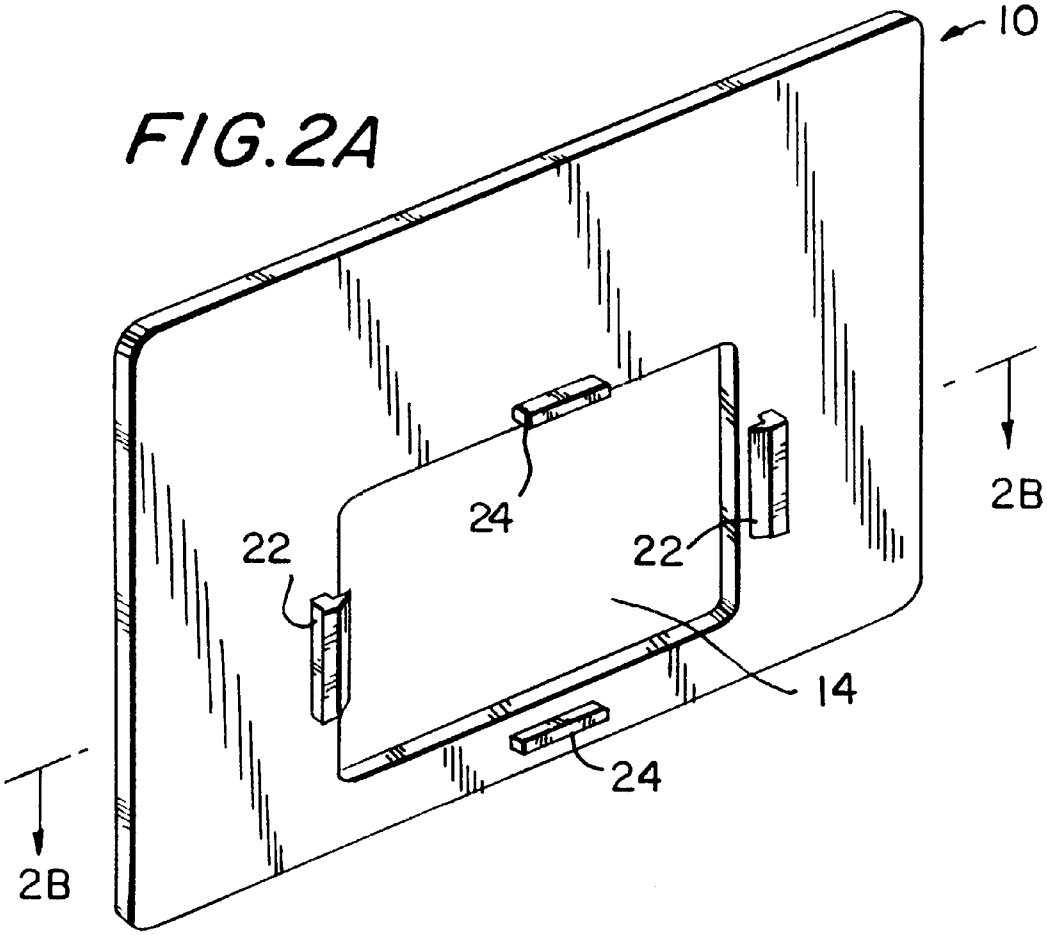
FIG. 2A is a perspective view of the rear of an advertising attachment having mounting hooks as an alternative mounting structure.
Figure 2B:
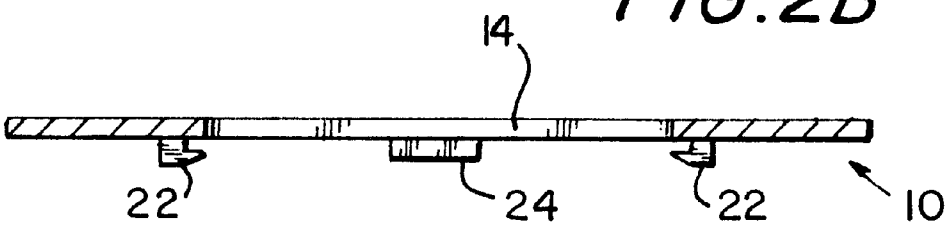
FIG. 2B is a view taken substantially through the plane B—B in FIG. 2A.

An alternative means of mounting the base plate 12 is through the use of mounting hooks 22 or a combination of mounting hooks 22 and tabs 24, as shown in FIGS. 2A and 2B. The mounting hooks 22, dimensioned for snugly fitting about the sides of the scanning plate 18, securely grips the sides of the scanning plate while tabs 24 abuts the top and bottom of the scanning plate 18 to prevent the base plate 12 from sliding off the scanning plate 18. The size of the hooks and spacing between them may be varied according to the size of the scanning plate. The mounting hooks and tabs may be molded or affixed to the base plate 12 using adhesive or other means of affixation that is well known in the arts.

Figure 3B:
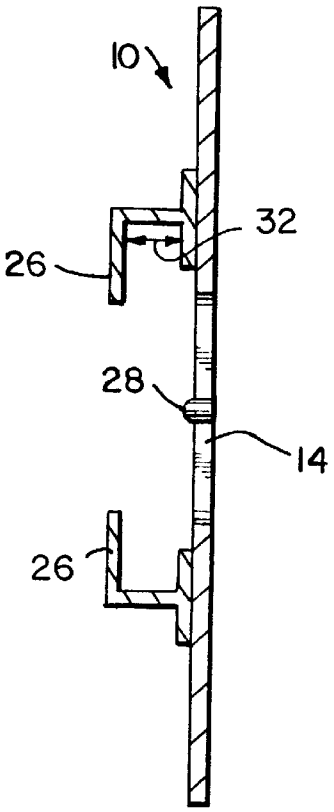
FIG. 3B is a view taken substantially through the plane B—B in FIG. 3A.
Figure 3A:
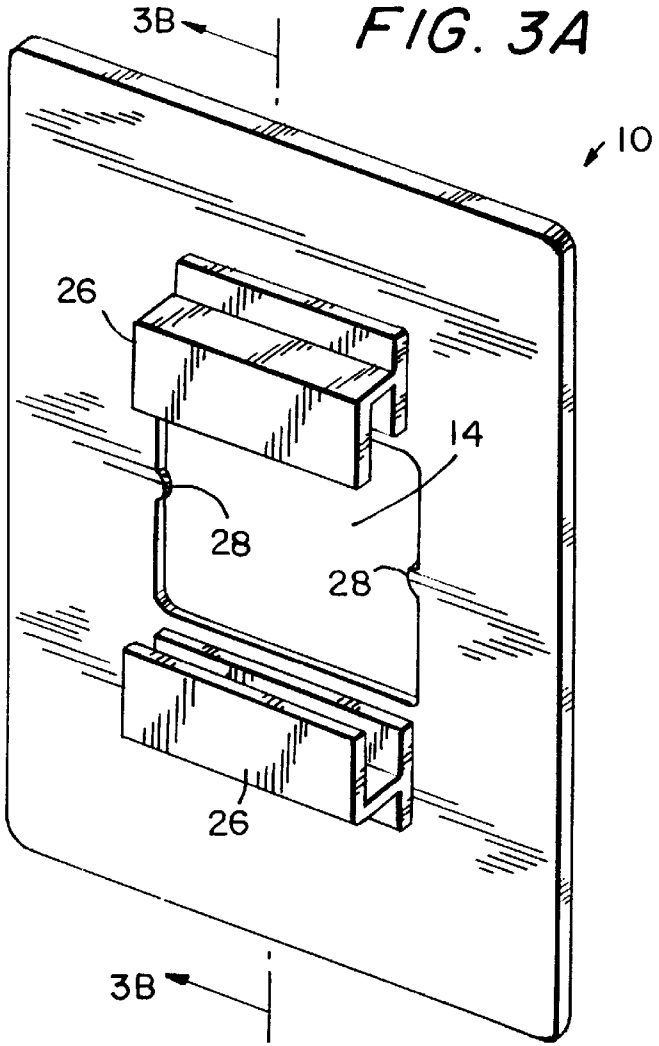
FIG. 3A is a perspective view of the rear of an advertising attachment having a pair of parallel ridges as a second alternative mounting structure.

Yet another means of mounting the base plate 12 to scanning plate 18 is through the use of a pair of parallel, gripping ridges 26, as shown in FIGS. 3A and 3B. The width of the ridges 32, best seen in FIG. 3B, are dimensioned to snugly fit over the sides of the scanning plate 12. These gripping ridges 26 may be molded or affixed to the base plate 12 using adhesive or other means of affixation that is well known in the arts. The base plate 12 may also have two ear-tabs 28 on the sides of the opening 14 which abut the sides of the scanning plate 18 to prevent the base plate from displacement.

In another embodiment, the structure for mounting is at least partially part of the scanning plate or bracket in the form of mounting hooks, tabs and/or ridges which engage complimentary structures on the base plate 12.

When the advertising attachment 10 is mounted on to the scanning plate 18 using one of the above mounting structures, it cannot be displaced by vibration or by ordinary physical contact, although it can be easily removed when needed.

The base plate 12 can assume a variety of different shapes to suit advertising need, such as rectangular, triangular, etc. Similarly, the location of the opening 14 may be maneuvered according to need.

As should by now be appreciated, the inventive advertising attachment allows for a highly simplified and economical means of effectively placing advertisement on a hanger bracket having a scanning plate. Moreover, the configuration of the inventive advertising attachment allows the scanning plate to be read or scanned while the compact design of the invention occupies minimal surface area of a display space thereby providing access to other displayed products.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

I claim:

1. An advertising display attachment for an information display comprising:

a display plate having a planar surface with an opening therethrough, said opening being positioned and sized to provide an unobstructed view therethrough of said information display when said display attachment is attached to said information display;

a face plate fixable to said planar surface, said face plate having an opening therethrough coincidental with the opening of said planar surface; and mounting means for receiving said information display.

2. The advertising display of claim 1 wherein said mounting means is a structure for releasably mounting the display attachment to the information display.

3. The advertising display attachment of claim 2 wherein the structure comprises a hook configured to engage the information display.

4. The advertising display attachment of claim 2 wherein the structure comprises a horizontal gripping edge configured to engage the information display.

5. The advertising display attachment of claim 2 wherein the structure comprises a slot configured to engage the information display.

6. An advertising display system comprising:

a first display plate attachable to an in-store hanger bracket for displaying product information, the first display plate having a display surface;

a second display plate mountable to the first display plate, wherein the second display plate has a planar surface defining an opening therethrough, the opening being configured to circumscribe the first display plate without obstructing the display surface thereof upon mounting of the second display plate onto the first display plate, the second display plate being releasably mounted to the first display plate; and a face plate having a planar surface with an opening therethrough and fixable to the second display plate.

7. The system of claim 6, further comprising a structure for mounting said second display plate to said first display plate, said structure including a hook disposed on said second display plate and configured to engage a side of said first display plate.

8. The system of claim 6, wherein said second display plate having a slot configured to mate with said first display plate.

9. The system of claim 6, further comprising a structure for mounting said second display plate to said first display plate, said structure including a horizontal gripping ridge disposed on said second display plate and configured to engage a side of said first display plate.

* * * * *